US011425996B2

(12) United States Patent
DeShon

(10) Patent No.: US 11,425,996 B2
(45) Date of Patent: Aug. 30, 2022

(54) CUSTOMIZABLE MODULAR SHELVING SYSTEM

(71) Applicant: 902a LLC, Lenexa, KS (US)

(72) Inventor: Chad W DeShon, Lenexa, KS (US)

(73) Assignee: 902a LLC, Lenexa, KS (US)

( * ) Notice: Subject to any disclaimer, the term of this patent is extended or adjusted under 35 U.S.C. 154(b) by 0 days.

(21) Appl. No.: 17/024,231

(22) Filed: Sep. 17, 2020

(65) Prior Publication Data

US 2021/0076816 A1 Mar. 18, 2021

Related U.S. Application Data

(60) Provisional application No. 62/901,559, filed on Sep. 17, 2019.

(51) Int. Cl.

| | |
|---|---|
| ***A47B 47/00*** | (2006.01) |
| ***A47B 87/02*** | (2006.01) |
| ***A47B 87/00*** | (2006.01) |
| ***A47B 45/00*** | (2006.01) |

(52) U.S. Cl.

CPC ..... *A47B 47/0091* (2013.01); *A47B 45/00* (2013.01); *A47B 87/008* (2013.01); *A47B 87/0276* (2013.01)

(58) Field of Classification Search

CPC ..... A47B 47/0091; A47B 87/008; A47B 87/0276; A47B 87/00; A47B 87/005; A47B 87/02; A47B 87/0207; A47B 87/0215; A47B 87/0223; A47B 87/0246; A47B 87/0253; A47B 87/0269; A47B 87/0284; A47B 87/0292; A47B 47/0066; A47B 47/0075; A47B 53/00; A47B 45/00; A47F 5/10; A47F 5/105

USPC ..... 211/188, 194, 153, 174; 312/107, 108, 312/109, 111; 206/503

See application file for complete search history.

(56) References Cited

U.S. PATENT DOCUMENTS

| | | | | | |
|---|---|---|---|---|---|
| 873,496 | A | * | 12/1907 | Bryant | A47B 87/0207 211/188 |
| 1,648,277 | A | * | 11/1927 | Korb | A47B 47/00 312/107 |
| 2,064,056 | A | * | 12/1936 | Cookson | A47F 5/10 108/101 |
| 2,506,844 | A | * | 5/1950 | Frederick | A47B 87/02 312/107 |
| 2,526,246 | A | * | 10/1950 | Benjamin | A47F 5/10 108/101 |

(Continued)

*Primary Examiner* — Jennifer E. Novosad
(74) *Attorney, Agent, or Firm* — Shook, Hardy & Bacon L.L.P.

(57) ABSTRACT

A modular shelving system is configured to store objects therein while having a customizable overall dimension. The system includes multiple modular shelf assemblies, each having a storage void, and a set of connectors. A first modular shelf assembly is configured to be secured, via a set of connectors, to a second modular shelf assembly and to a third modular shelf assembly. An additional storage void is formed between the first storage void, the second storage void, and the third storage void. The fourth storage void is configured to store objects therein. The location in which the first modular shelf assembly is configured to be connect to other modular shelf assemblies is selected by a user to meet the customizable overall dimension.

10 Claims, 9 Drawing Sheets

(56) References Cited

U.S. PATENT DOCUMENTS 2,529,649 A * 11/1950 Coplen ..... A47B 47/021 108/190
2,645,545 A * 7/1953 Rozaffy ..... A47B 47/042 312/108
3,347,610 A * 10/1967 Pilliod ..... F16B 12/04 312/263
3,552,817 A * 1/1971 Marcolongo ..... A47B 87/02 312/107
3,563,624 A * 2/1971 Stice ..... A47B 87/00 312/111
3,567,300 A * 3/1971 Mari ..... A47B 87/0276 312/257.1
3,722,704 A * 3/1973 Piretti ..... A47B 47/047 211/183
3,722,971 A * 3/1973 Zeischegg ..... A47B 47/042 312/107
3,743,372 A * 7/1973 Ruggerone ..... A47B 87/02 312/108
3,841,725 A * 10/1974 Dorner ..... A47B 87/00 312/107
3,913,289 A * 10/1975 Recker ..... F16B 5/0607 312/140
4,184,599 A * 1/1980 Drake ..... B65D 71/70 206/708
4,243,279 A * 1/1981 Ackeret ..... B65D 21/0201 108/64
4,304,079 A * 12/1981 Thorsten ..... E04B 5/48 174/483
4,322,118 A * 3/1982 Shugart ..... A47B 87/02 211/42
4,355,485 A * 10/1982 Frank ..... A01G 9/023 47/82
4,423,913 A * 1/1984 Lee ..... A47B 87/0276 211/194
4,592,601 A * 6/1986 Hlinsky ..... A47B 87/02 206/504
4,681,378 A * 7/1987 Hellman, III ..... A47B 21/00 211/188
4,903,451 A * 2/1990 Gresswell ..... A47B 87/0276 312/111
5,016,946 A * 5/1991 Reznikov ..... A47B 87/02 312/108
5,046,789 A * 9/1991 Lee ..... F16B 12/46 312/108
5,285,907 A * 2/1994 Franchere ..... A47B 87/00 211/194
5,689,929 A * 11/1997 Newsom ..... E04B 2/00 211/188
5,775,046 A * 7/1998 Fanger ..... A47B 81/06 108/157.16
6,050,657 A * 4/2000 Hiltzman ..... A47B 87/007 312/107
6,054,968 A * 4/2000 De Matteo ..... G09F 15/0068 312/7.2
6,102,219 A * 8/2000 Wang ..... A47B 87/00 211/194
6,230,909 B1 * 5/2001 Suter ..... A47B 87/00 211/188
6,401,946 B1 * 6/2002 Chalasani ..... H01M 50/20 211/188
6,520,095 B1 * 2/2003 Hayes ..... A47B 47/047 108/190
6,634,513 B1 * 10/2003 Hardy ..... A47B 87/007 211/194
6,749,070 B2 * 6/2004 Corbett, Jr. ..... A47B 96/1441 211/126.12
6,820,950 B1 * 11/2004 Sun ..... A47B 47/042 312/108
6,834,920 B2 * 12/2004 Landsberger ..... A47B 47/0091 312/108
6,991,115 B2 * 1/2006 Chow ..... G11B 33/0483 211/188
7,100,999 B2 * 9/2006 Stravitz ..... A47B 87/008 312/108
D553,393 S * 10/2007 Cassel ..... D6/675.1
7,591,382 B2 * 9/2009 Brock ..... A45D 33/26 211/10
7,918,515 B2 * 4/2011 Wang ..... A47B 47/005 312/108
7,963,404 B2 * 6/2011 Shang ..... A47F 7/08 211/36
7,997,213 B1 * 8/2011 Gauthier ..... B65D 88/022 108/55.1
8,113,600 B2 * 2/2012 Zalewski ..... A47B 47/0041 312/111
8,210,379 B2 * 7/2012 Afflerbach ..... B65D 11/1873 220/4.31
8,296,981 B1 * 10/2012 Gardinier ..... G09F 7/10 40/605
8,297,206 B2 * 10/2012 Meiners ..... A47C 1/124 108/64
D725,413 S * 3/2015 Aleisa ..... D6/675
9,016,485 B1 * 4/2015 Liu ..... A47B 47/0016 211/189
9,078,515 B2 * 7/2015 Keragala ..... A47C 13/005
9,095,212 B2 * 8/2015 Yamamoto ..... A47B 87/0276
9,185,975 B2 * 11/2015 Franklin ..... H05K 7/1488
9,526,333 B1 * 12/2016 Nielson ..... A47B 47/0091
10,544,818 B2 * 1/2020 Fridlund ..... F16B 12/26
10,555,605 B1 * 2/2020 Berger ..... A47B 47/047
10,610,011 B1 * 4/2020 Greenhill ..... A47B 23/043
10,830,266 B2 * 11/2020 Fridlund ..... B27M 1/08
10,856,658 B2 * 12/2020 Berloni ..... A47B 77/02
2003/0010738 A1 * 1/2003 Hsia ..... A47B 87/007 211/188
2006/0207957 A1 * 9/2006 Chen ..... A47B 47/0066 211/188
2009/0302725 A1 * 12/2009 Rogers ..... A47B 87/0284 312/257.1
2012/0242200 A1 * 9/2012 Keragala ..... F16B 12/14 312/111
2016/0081472 A1 * 3/2016 Aleisa ..... A47B 87/0292 211/188
2016/0095430 A1 * 4/2016 Moyer ..... A47B 47/0091 312/265.4
2017/0127825 A1 * 5/2017 Melnick ..... F16B 1/00
2018/0192772 A1 * 7/2018 Yamamoto ..... A47B 88/941
2020/0240132 A1 * 7/2020 Barreto ..... E04B 1/40
2021/0076816 A1 * 3/2021 DeShon ..... A47B 45/00

* cited by examiner

CUSTOMIZABLE MODULAR SHELVING SYSTEM

RELATED APPLICATIONS

This non-provisional patent application claims priority benefit, with regard to all common subject matter, of commonly assigned U.S. provisional patent application Ser. No. 62/901,559, filed Sep. 17, 2019, and entitled "CUSTOMIZABLE MODULAR SHELVING SYSTEM." This application is hereby incorporated by reference in its entirety into the present application.

FIELD OF THE INVENTION

The present disclosure generally relates to shelving systems and other structures for holding objects.

BACKGROUND

Shelving systems are common in homes and other buildings. Shelving systems are typically of standard dimensions with little or no customization possible. For shelving systems there are two common size considerations. The first size consideration is one or more bay dimensions. The bay dimensions are a measure of a length, a width, and a depth of one or more individual bays. Bay dimensions are selected based upon the objects to be stored on the shelving system. The second size consideration is one or more overall size dimensions. The overall size dimensions are a measure of a length, a width, and a depth of the overall shelving system. Overall dimensions are selected based upon the physical space available. Some shelving systems of the prior art allow limited bay dimension customization by allowing the user to select the vertical placement position of individual shelves.

Users often have a certain physical space within a building in which they will utilize a shelving system. Because shelving systems of the prior art typically are not customizable by an end user in overall dimension, the user has two sub-optimal choices. First, is to select a readily available shelving system that is of smaller overall dimensions than the physical space available. This is disadvantageous because it wastes the available space and is not as aesthetic. Second, is to commission a custom shelving system. This is disadvantageous because custom building is expensive.

What is lacking in the prior art is a shelving system that allows for much greater customization in both bay dimensions and overall dimensions by the end user. This background discussion is intended to provide information related to the present invention which is not necessarily prior art.

BRIEF SUMMARY

Embodiments of the invention solve the above-mentioned problem (as well as other problems) by providing a customizable modular shelving system. The customizable shelving system includes a set of modular shelf assemblies. The user selects individual modular shelf assemblies based upon their respective sizes, the sizes of the objects to be stored, and the physical space available in the building. The user assembles the modular shelf assemblies individually and then assembles the completed modular shelf assemblies into a customizable modular shelf system. Thus, by selecting a number and size of modular shelf assemblies and a manner in which to secure them together, the user can maximize use of the available space.

A first embodiment of the invention is broadly directed to a modular shelving system configured to store objects therein. The system includes three modular shelf assemblies and a set of connectors. A first modular shelf assembly presents a first storage void. A second modular shelf assembly presents a second storage void. A third modular shelf assembly presents a third storage void. The first modular shelf assembly is configured to be secured, via the set of connectors, to the second modular shelf assembly and to the third modular shelf assembly. A fourth storage void is formed between the first storage void, the second storage void, and the third storage void. The fourth storage void is configured to store objects therein.

A second embodiment of the invention is broadly directed to a modular shelf assembly comprising a set of walls, a channel opening, and a set of connectors. The set of walls presents a storage void therein. The set of walls includes a first wall. The channel opening is disposed in the first wall and presents a first position and a second position therein. The first position is laterally distinct from the second position. The connector is configured to traverse the channel opening. The connector is configured to secure the first wall to an external modular shelf assembly via the channel opening in the first position. The connector is configured to secure the first wall to the external modular shelf assembly via the channel opening in the second position.

A third embodiment of the invention is broadly directed to a method of assembling a modular shelving system configured to store objects therein, comprising: acquiring a first modular shelf assembly; acquiring a second modular shelf assembly; acquiring a third modular shelf assembly; acquiring a set of connectors; securing, via the set of connectors, the first modular shelf assembly to the second modular shelf assembly; securing, via the set of connectors, the first modular shelf assembly to the third modular shelf assembly, wherein a void is formed between the first modular shelf assembly, the second modular shelf assembly, and the third modular shelf assembly, wherein the first modular shelf assembly, the second modular shelf assembly, the third modular shelf assembly, and the void are each configured to store objects therein.

Advantages of these and other embodiments will become more apparent to those skilled in the art from the following description of the exemplary embodiments which have been shown and described by way of illustration. As will be realized, the present embodiments described herein may be capable of other and different embodiments, and their details are capable of modification in various respects. Accordingly, the drawings and description are to be regarded as illustrative in, nature and not as restrictive.

BRIEF DESCRIPTION OF THE DRAWINGS

The Figures described below depict various aspects of systems and methods disclosed therein. It should be understood that each Figure depicts an embodiment of a particular aspect of the disclosed systems and methods, and that each of the Figures is intended to accord with a possible embodiment thereof. Further, wherever possible, the following description refers to the reference numerals included in the following Figures, in which features depicted in multiple Figures are designated with consistent reference numerals. The present embodiments are not limited to the precise arrangements and instrumentalities shown in the Figures.

Figure 1:
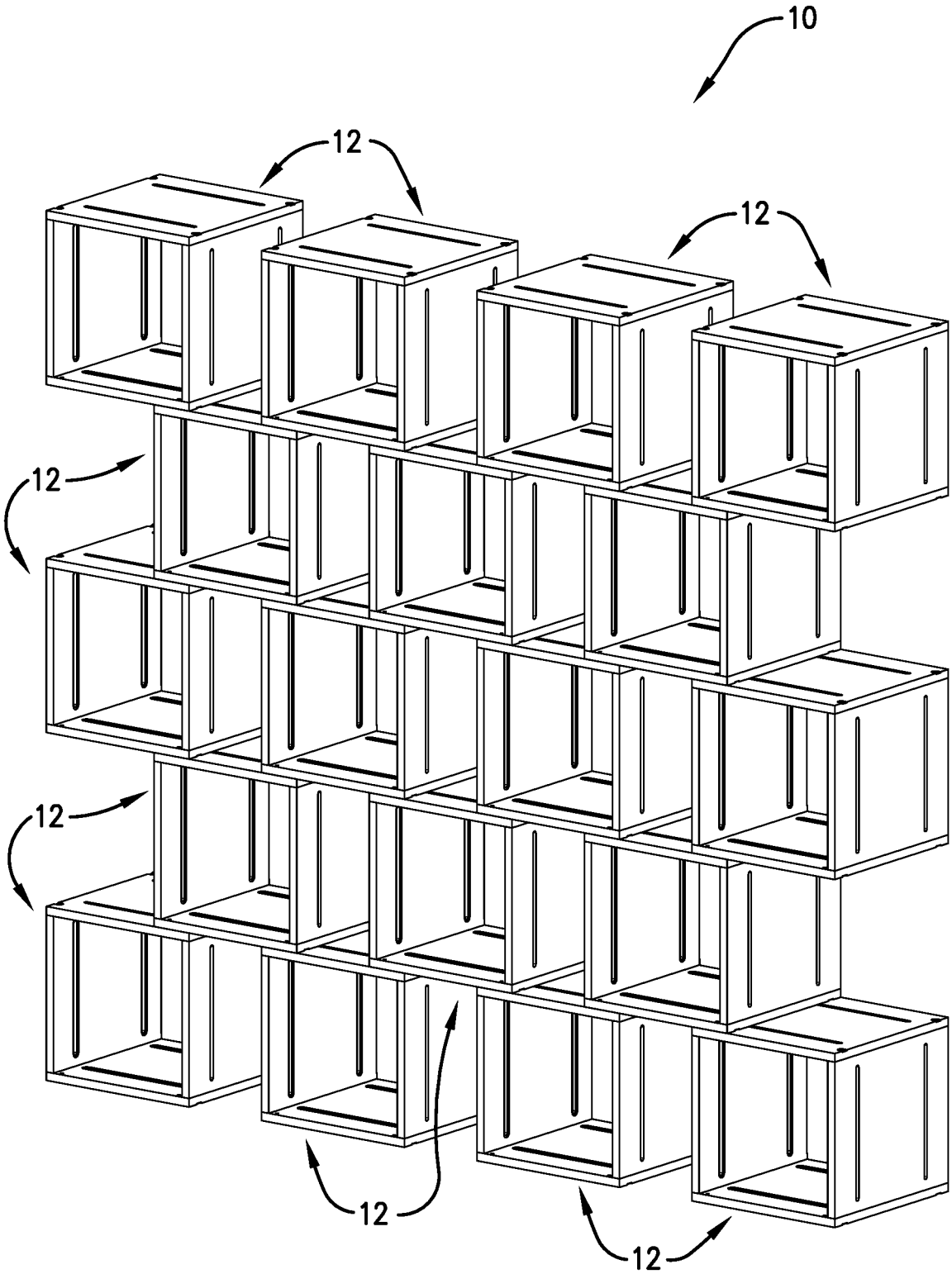
FIG. 1 is a perspective view of a modular shelving system, including eighteen modular shelving assemblies.

The Figures depict exemplary embodiments for purposes of illustration only. One skilled in the art will readily recognize from the following discussion that alternative embodiments of the systems and methods illustrated herein may be employed without departing from the principles of the invention described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments. For instance, the drawing figures do not limit the present invention to the specific embodiments disclosed and described herein. Furthermore, directional references (for example, top, bottom, up, and down) are used herein solely for the sake of convenience and should be understood only in relation to each other. For instance, a component might in practice be oriented such that faces referred to as "top" and "bottom" are sideways, angled or inverted relative to the chosen frame of reference. Use of directional terms such as "upper," "lower," "top," "bottom," "above," "below," "front," "forward," "backward," "anterior," "posterior," "left," "right," etc. are intended merely for orientation, to describe the positions and/or orientations of various components to one another, and are not intended to impose limitations on any position and/or orientation of any embodiment of the invention relative to any reference point external to the reference.

EXEMPLARY ENVIRONMENT

Embodiments of the invention are directed to a modular shelving system 10 that comprises a set of modular shelf assemblies 12 and a set of connectors 14 and is configured to allow for customization to fit various spaces and objects. Before discussing the modular shelving system 10, a few exemplary environments related to exemplary fields of use will be described.

A first exemplary environment will be in buildings, such as a home or business. In the building, there may be one or more areas in which various items need to be stored. This area is a physical space that may be on a floor of the building, on another article of furniture, etc. The area may also be defined by one or more walls of the building, or another article of furniture. These areas tend to be of a non-standard size, because when the building was built the exact purpose and storage needs are often not considered. Because (as discussed above) shelving systems of the prior art typically are not customizable by an end user in overall dimension, the user has two sub-optimal choices. First, is to select a readily available shelving system that is of smaller overall dimensions than the physical space available. This is disadvantageous because it wastes the available space and is not as aesthetic. Second, is to commission or build a custom shelving system. This is disadvantageous because custom building is expensive and time-consuming. Embodiments of the invention, configured for this exemplary environment, thus provide a third more-optimal solution. The user can manually and easily construct a customized modular shelving system 10 from two or more modular shelving assemblies. The user may select the overall dimension of the modular shelving system 10 to accurately fit the area. This selection may allow customization in a horizontal and/or vertical direction.

Embodiments of the invention are configured to be used to store various objects that may need to be accessed from or displayed in the area. There are a plethora of exemplary objects that may be stored in the modular shelving system 10 of this exemplary environment. A few non-limiting examples will be discussed herein. For example, some embodiments of the invention are configured to store books, board games, home décor, food items, cleaning supplies, and other objects.

A second exemplary field of use is in vehicles. Vehicles typically include limited storage options, such as in trailers or cabs. The available space is also of an atypical size. Embodiments of the invention are thus configured for addition to a vehicle to provide additional storage options therein. A few non-limiting examples would include tools, repair parts, and the like.

A third exemplary field of use is in temporary and/or transportable storage. In this field of use, embodiments of the invention are configured to be formed of numerous relatively small components. The temporary and/or transportable storage is thus configured to be assembled in the temporary location from these easily transportable smaller components. When complete at the temporary location, the user will disassemble the embodiment of the invention and return it to the individual components. A few non-limiting examples would include medical supplies, repair supplies, and the like.

EXEMPLARY MODULAR SHELVING SYSTEM

Figure 2:
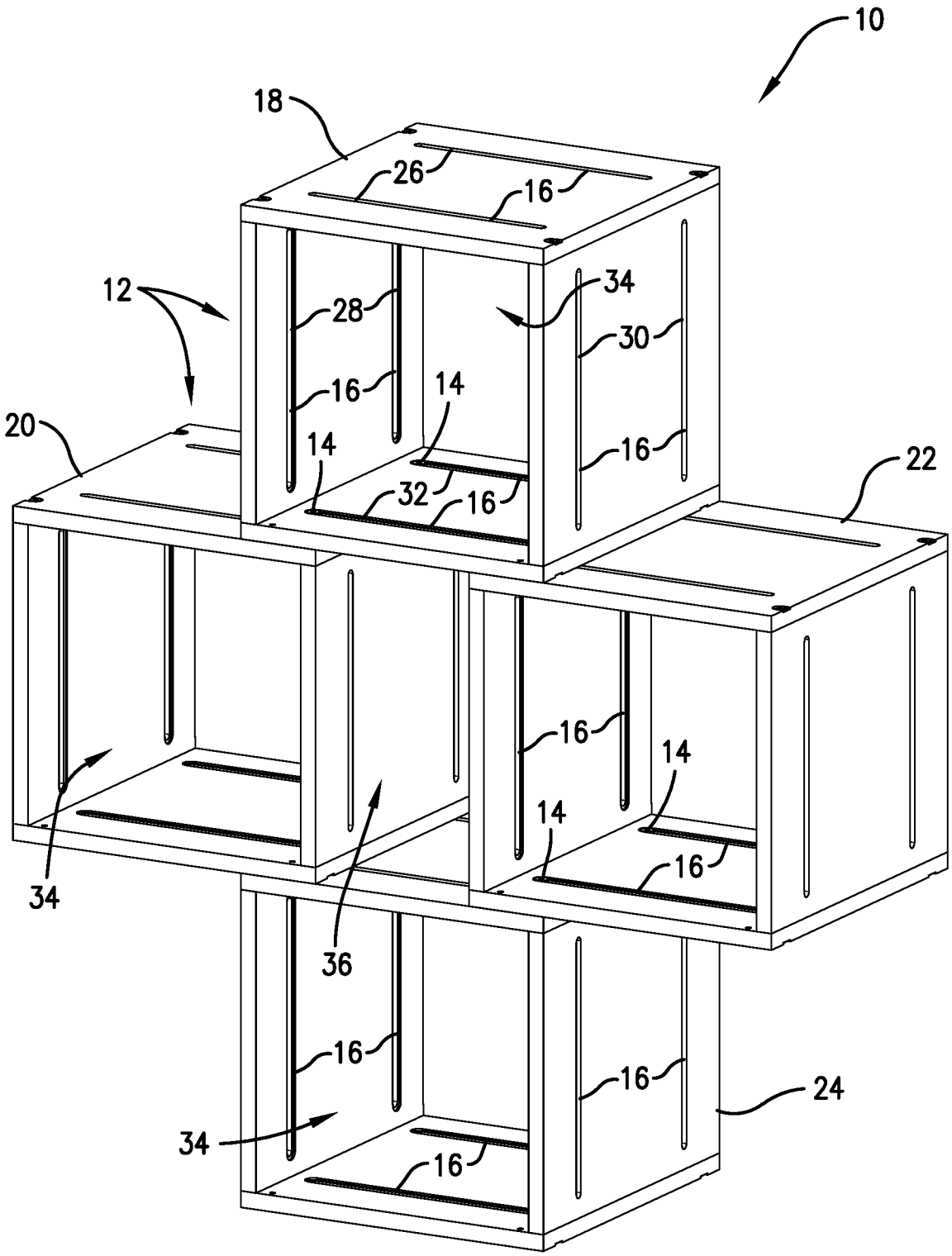
FIG. 2 is a perspective view of a modular shelving system, including four modular shelving assemblies.

Turning to FIG. 1, the drawing figures will now be discussed. Embodiments of the invention are directed to a modular shelving system 10 that is configured to store objects therein. In embodiments, the modular shelving system 10 comprises a set of modular shelf assemblies 12 and a set of connectors 14. The set of connectors 14 is configured to secure the set of modular shelf assemblies 12 together, such that the modular shelf assemblies 12 are held in a fixed relative position, as shown in FIGS. 1 and 2.

The modular shelf assemblies 12 are of a static dimension (which may include multiple modular shelf assemblies 12 of two or more distinct, static dimensions), but the vertical and/or horizontal spacing between the modular shelf assemblies 12 may be customized by the user. This can be seen in FIG. 1, where it can be appreciated that the respective modular shelf assemblies 12 could be horizontally spaced closer or further from the adjacent modular shelf assemblies 12. In another arrangement, such as if FIG. 1 were viewed from the side, the customized spacing is vertical.

Thus, the user can maximize physical space available by selecting where to secure the successive modular shelving assemblies relative to each other. A first modular shelf assembly 12 is secured by the user to a second modular shelf assembly 12 via one or more connector 14. The connector 14 is secured through a channel opening 16 of the first modular shelf assembly 12 and a channel opening 16 of the second modular shelf assembly 12. The connector 14 is configured to selectively hold or release the first modular shelf assembly 12 to the second modular shelf assembly 12.

Each channel opening 16 is elongated such that the user may select where along the channel opening 16 to secure the connector 14. By selecting a first location along the first channel opening 16 of the first modular shelf assembly 12 and a corresponding location along the corresponding channel opening 16 of the second modular shelf assembly 12, the user can customize the relative locations of the first modular assembly and the second modular assembly.

FIG. 2 shows more detail of one embodiment of the modular shelving system 10. The modular shelving system 10 as shown in FIG. 2 includes four modular shelf assemblies 12. In the shown example, there is a upper modular shelf assembly 18, a left modular shelf assembly 20, a right modular shelf assembly 22, and a lower modular shelf assembly 24. It should be appreciated that the layout FIG. 2 is only exemplary and that any combination of modular shelf assemblies 12 in any of various shapes and sizes may be utilized in embodiments of the invention. The respective modular shelf assemblies 12 are secured to each other via the connectors 14. This is best shown in FIG. 2 on a lower side of the right modular shelf assembly 22.

Figure 3:
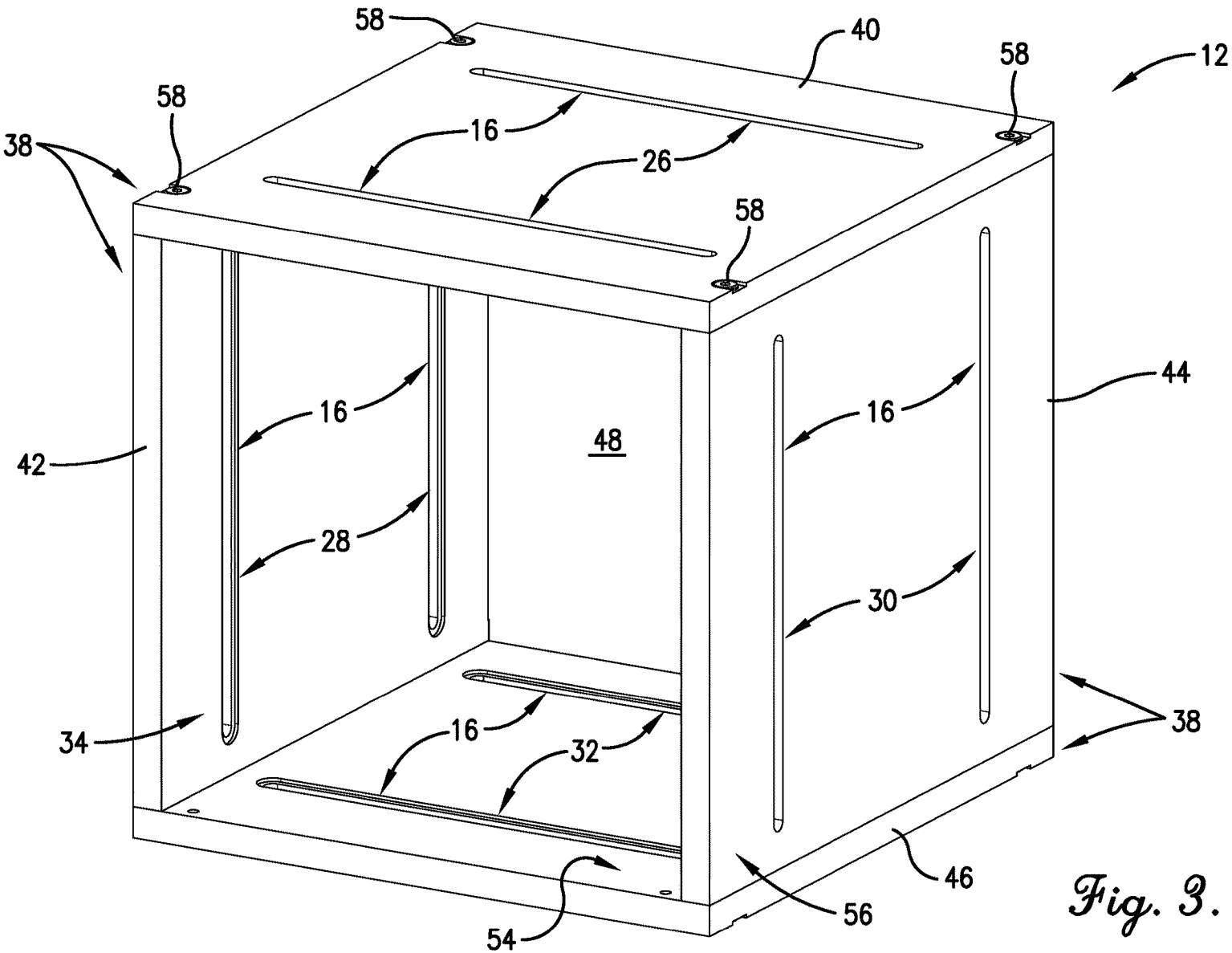
FIG. 3 is a perspective view of a modular shelving assembly.

As can be seen in FIGS. 2 and 3, each modular shelf assembly 12 includes two upper channel openings 26, two left-side channel openings 28, two right-side channel openings 30, and two bottom channel openings 32. The channel openings 16 are all parallel with each other. It should be appreciated that in other embodiments, more or fewer channel openings 16 may be used. It should also be appreciated that some embodiments may include one or more channel openings 16 of another shape (other than linear as shown), such as arcuate, angled, hooked. In still other embodiments, the channel openings 16 may include one or more circular single-point openings.

As can be seen in Illustration 2, the upper modular shelf assembly 18 is secured to both the left modular shelf assembly 20 and the right modular shelf assembly 22. The upper modular shelf assembly 18 is secured to each of the left modular shelf assembly 20 and the right modular assembly via the connectors 14. Each of the modular shelf assemblies 12 presents a static storage void 34 therein. The static storage void 34 is permanent for the modular shelf assembly 12, based upon the respective dimensions of that modular shelf assembly 12. Thus, a variable storage void 36 is formed between the other static storage voids 34. It should be appreciated that the dimensions of the variable storage void 36 are not static nor the same as the static storage void 34. The dimensions can be set by the user in determining where to secure the respective modular shelf assemblies 12 together.

Continuing on FIG. 2, each modular shelf assembly 12 presents at least one static storage void 34 therein. A first modular shelf assembly 12 (such as the upper modular shelf assembly 18) presents a first static storage void 34. A second modular shelf assembly 12 (such as the left modular shelf assembly 20) presents a second static storage void 34. A third modular shelf assembly 12 (such as the right modular shelf assembly 22) present a third static storage void 34. A fourth modular shelf assembly 12 (such as the lower modular shelf assembly 24) presents a fourth static storage void 34. As shown, the first modular shelf assembly 12 is configured to be secured, via the set of connectors 14, to the second modular shelf assembly 12 and to the third modular shelf assembly 12. As shown, the fourth modular shelf assembly 12 is configured to be secured, via the set of connectors 14 to the second modular shelf assembly 12 and to the third modular shelf assembly 12. It should be appreciated that some connectors 14 are not visible in FIG. 2.

The variable storage void 36 is formed between the first static storage void 34, the second static storage void 34, the third static storage void 34, and the fourth static storage void 34. In other instances, such as shown in FIG. 1, The variable storage void 36 may be open on the top, left, right, and/or bottom. The variable storage void 36 did not exist before the respective modular shelf assemblies 12 were attached. The variable storage void 36 is thus created by the custom attachment of the respective modular shelf assemblies 12. The variable storage void 36 is configured to store objects therein. The variable storage void 36 thus provides additional storage beyond the storage provided by the static storage voids 34 associated with the respective modular shelf assemblies 12.

As shown in FIG. 2, the left modular shelf assembly 20 and the right modular shelf assembly 22 are separated by a lateral distance. The width of the variable storage void 36 is said lateral distance. The lateral distance is selected by a user to fill a physical space. The user selects the later distance by deciding where along the channel openings 16 to secure the connector 14. In order to fill the physical space available, the user may select where along the channel opening 16 to secure the two respective modular shelf assemblies 12.

Exemplary Components of the Modular Shelf Assembly

Figure 4:
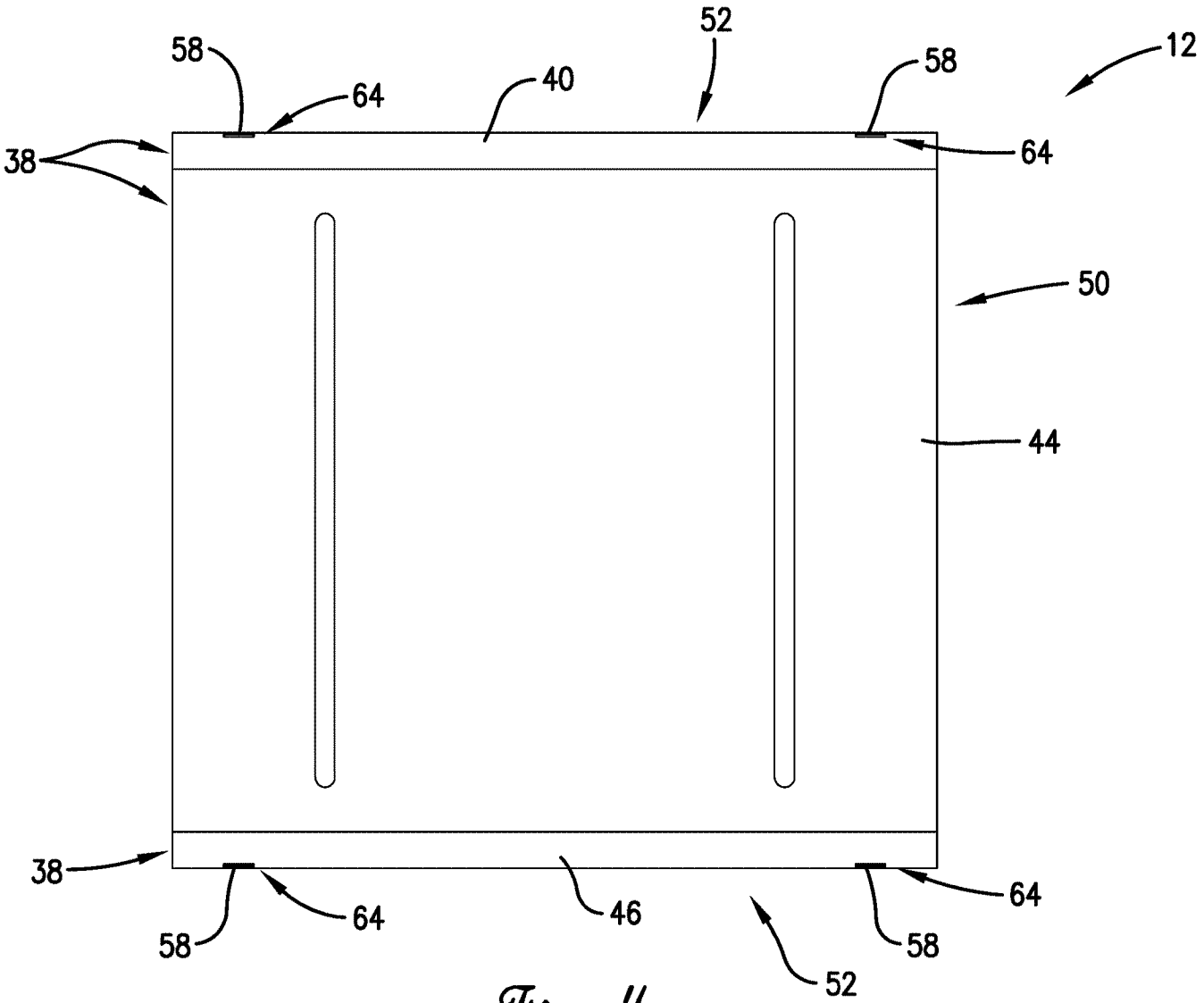
FIG. 4 is a side view of the modular shelving assembly of FIG. 3.

Turning to FIGS. 3 and 4, the individual modular shelf assemblies 12 will now be discussed in more detail. The modular shelf assembly 12 may present any of numerous shapes and sizes. The modular shelf assembly 12 is distinct and self-contained. The modular shelf assembly 12 can be moved and attached to the other modular shelf assemblies 12 independently.

In embodiments of the invention, the modular shelf assembly 12 comprises a set of walls 38 presenting a static storage void 34 therein. The set of walls 38 define the static storage void 34. The set of walls 38 present an overall shape for the modular shelf assembly 12. As shown in FIG. 3, in some embodiments the overall shape is a rectangular prism, such as a cube. In these embodiments, the static storage void 34 is also of a rectangular prism, such as a cube, shape. The set of walls 38 may include a first wall, a second wall, a third wall, and a fourth wall. The first wall, the second wall, the third wall, and the fourth wall each include a distinct channel opening 16. The first wall, the second wall, the third wall, and the fourth wall each include a second distinct channel opening 16.

In embodiments of the invention, the set of walls 38 includes a upper wall 40, a left sidewall 42, a right sidewall 44, and a lower wall 46. In some embodiments, the set of walls 38 further includes a posterior wall 48. In embodiments of the invention, the upper wall 40 and the lower wall 46 are interchangeable and thus defined by their position. In embodiments of the invention, the left sidewall 42 and the right sidewall 44 are interchangeable and thus defined by their position. In these embodiments, the left sidewall 42 and the right sidewall 44 may be generically referred to as sidewalls 50, and the upper wall 40 and lower wall 46 may be generically referred to as cap walls 52. The sidewalls 50 and the cap walls 52 each include an inner face 54 and an outer face 56. The inner face 54 is oriented toward the above-discussed static storage void 34. The outer face 56 may, depending upon relative dispositions of the modular shelf assemblies 12, be oriented toward a variable storage void 36 formed between the modular shelf assemblies 12 (as discussed above).

The sidewalls 50 may be disposed between cap walls 52, such as at a top end of each sidewall 50 is disposed against the upper wall 40, and a bottom end of each sidewall 50 is disposed against the lower wall 46. This is best shown in FIG. 4. The sidewall 50 is shown between the upper wall 40 and the lower wall 46. This arrangement allows for the sidewall 50 to be secured to the cap walls 52, as discussed below.

Figure 5:
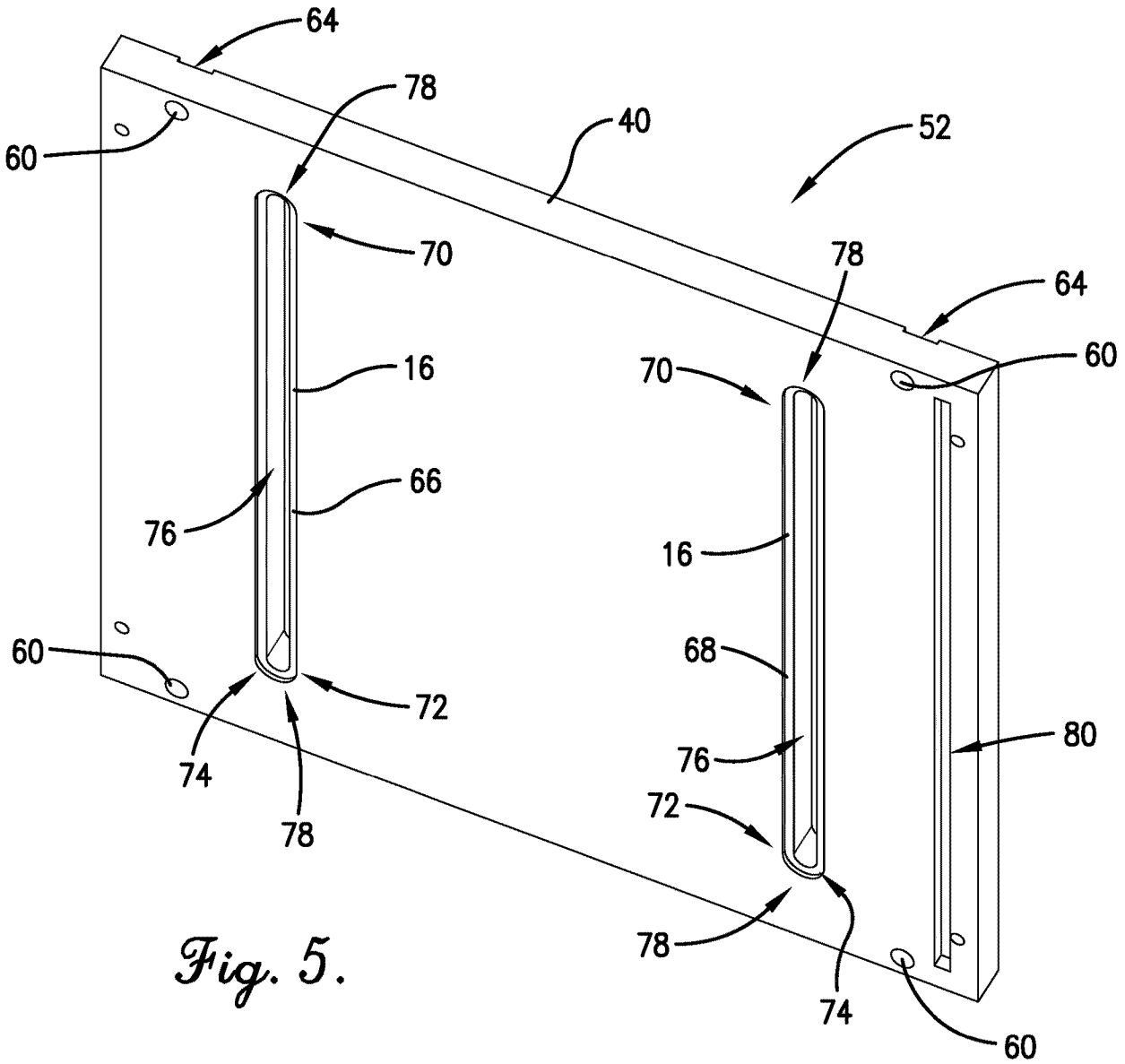
FIG. 5 is a perspective view of a top panel of the modular shelving assembly of FIG. 3.

The sidewalls 50 and the cap walls 52 may be secured by one or more fasteners 58, as best shown in FIG. 3. The fasteners 58 may be secured into an opening 60 (shown in FIG. 5) in the cap wall 52 and a corresponding opening 62 (shown in FIG. 6) in the sidewalls 50. The fastener may be a screw, a bolt, or other mechanical fastener. The fastener may be configured to sit flush inside a fastener recess 64 in the cap wall 52, as shown in FIG. 5. The fastener recess 64 allows the cap wall 52 to remain flat even with the fastener is secured therein, as best shown in FIG. 4. Alternatively or additionally, a chemical adhesive, a weldment, or other securing structure may be utilized.

Figure 6:
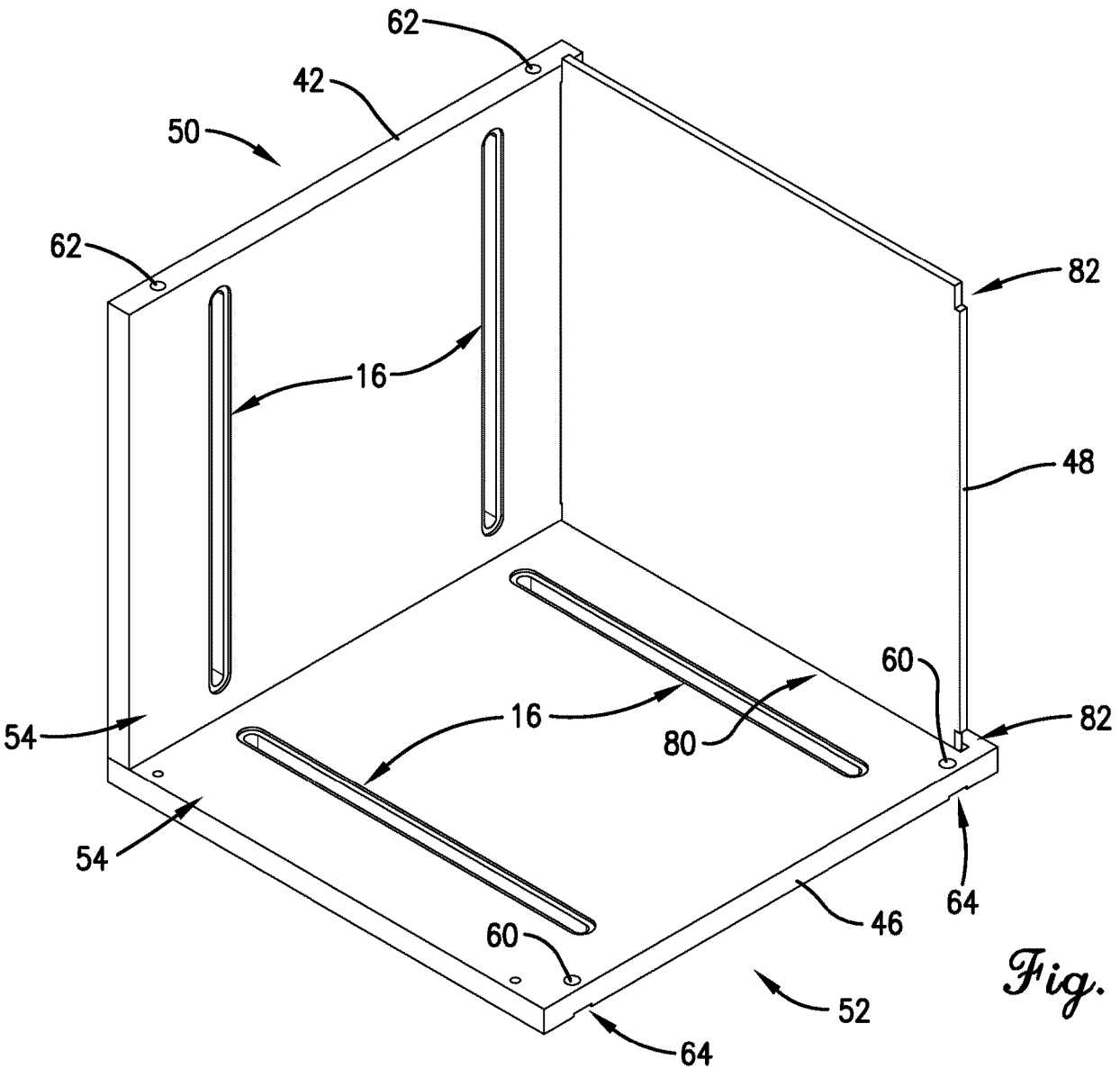
FIG. 6 is a perspective view of a partially constructed modular shelving assembly, showing a sidewall, a posterior wall, and a lower wall.

As best shown in FIGS. 5 and 6, the first wall 38 presents a first fastener opening 60, and the second wall 38 presents a second fastener opening 62. The first fastener opening 60 is configured to be aligned with the second fastener opening 62 such that the fastener can permanently secure the first wall 38 to the second wall 38 via the first fastener opening 60 and the second fastener opening 62.

Turning to FIG. 5, an exemplary cap wall 52 is shown. As can be seen, the cap wall 52 is generally flattened rectangular prism shaped. The cap wall 52 includes one or more openings and recesses therein, as discussed below. The cap wall 52 includes a first channel opening 66 and a second channel opening 68. The first channel opening 66 is disposed in the cap wall 52 presenting a first position 70 and a second position 72 therein. The second channel opening 68 is disposed in the cap wall 52 presenting a first position 70 and a second position 72 therein. The first position 70 is laterally distinct from the second position 72, for both the first channel opening 66 and the second channel opening 68. The first channel opening 66 and the second channel opening 68 each also includes numerous intermediary positions between the first position 70 and the second position 72. The user may select the first position 70, the second position 72, or one of the intermediary positions in order to customize the arrangement of the modular shelf assemblies 12, as discussed above. As can be seen, in embodiments of the invention, the second channel opening 68 is disposed parallel to the first channel opening 66.

The first channel opening 66 is configured to receive a first connector 14 (discussed below) while the second channel opening 68 is configured to receive a second connector 14 (discussed below). The first connector 14 and the second connector 14 are both configured to secure the first wall to said external modular shelf assembly 12 via the first channel opening 66 and the second channel opening 68, respectively (as shown in FIG. 2). Typically, the first connector 14 will be disposed at the same location of the first channel opening 66 as the second connector 14 is disposed of the second channel opening 68. In other embodiments, more or fewer channel openings 16 may be disposed in the cap wall 52 and may be disposed perpendicular or askew of one of the other channel openings 16.

Each channel opening 16 includes a head recess 74 and a traversing channel 76. The head recess 74 is configured to recess all or a portion of the connector 14, as discussed below. The traversing channel 76 is disposed between the inner face 54 and the outer face 56 of the wall. Head recess 74 is disposed on the inner face 54 but not on the outer face 56. This is because the connector 14 will traverse from the inner face 54 of a first modular shelf assembly 12 to the inner face 54 of the second modular shelf assembly 12. There is thus no locking along the outer face 56 of the wall. The traversing channel 76 and the head recess 74 both present arcuate ends 78 at the first position 70 and the second position 72, configured to accommodate a circular connector 14 therein.

Turning to FIG. 6, an exemplary sidewall 50 is shown, in combination with a cap wall 52 and a posterior wall 48. FIG. 6 shows how the various walls fit together. The posterior wall 48 is disposed within a posterior wall slot 80 in the lower wall 46 as well as the posterior wall slot 80 in the upper wall 40 (shown in FIG. 5). The posterior wall 48 includes a posterior wall notch 82 configured to fit around the posterior wall slot 80 and hold the posterior wall 48 in position. The posterior wall 48 is adjacent to the first wall, the second wall, the third wall, and the fourth wall. In other embodiments, the modular shelf assembly 12 includes the upper wall 40, the left sidewall 42, the right sidewall 44, and the lower wall 46 without a posterior wall 48, such that a posterior end of the modular shelf assembly 12 is left open.

Figure 7:
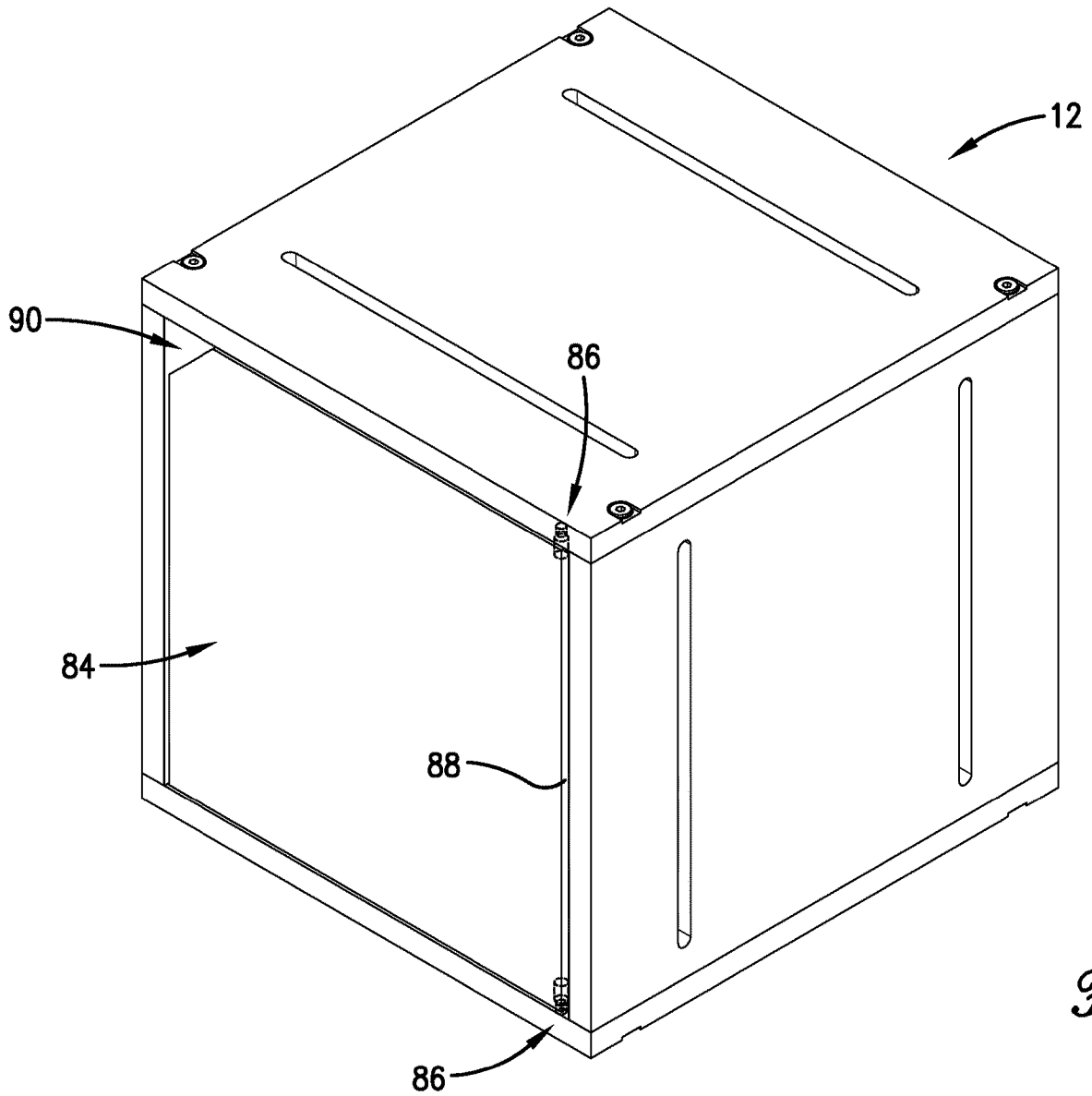
FIG. 7 is a perspective view of a modular shelving assembly, having a door on an anterior side.

Turning to FIG. 7, an alternative embodiment including a door 84 is shown. The door 84 provides a temporary wall that is selectively openable. The door 84 may be considered a wall of the set of walls 38. The door 84 is pivotably secured to the first wall and the second wall, such that the door 84 may pivotably swing open. The door 84 is pivotably secured at two door recesses 86 (as shown in FIGS. 5. and 6), via two corresponding post protrusions. The door 84 is pivotably secured via a door post 88. The door post 88 traverses through the door 84. The post protrusions extend from the door post 88 into the corresponding door recesses 86. In some embodiments, as shown in FIG. 7, the door 84 is reversable, such that it can be oriented to open on a right side or open on a left side, with corresponding door recesses 86 on the left side and the right side. In some embodiments, the door 84 may include a handle recess configured to be grasped by the user to open the door 84. In other embodiments, the door 84 may include another type of handle.

Figure 8:
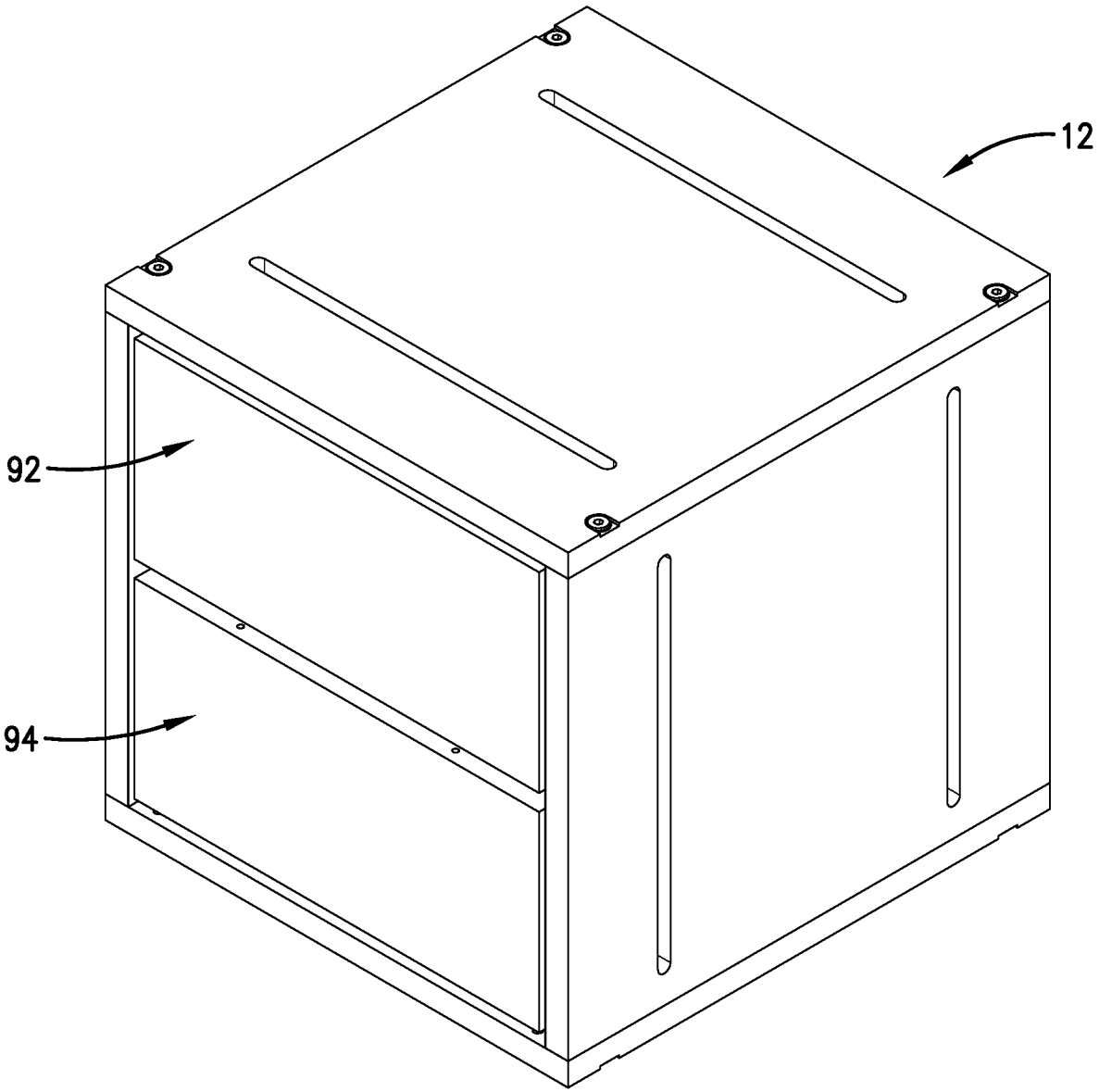
FIG. 8 is a perspective view of a modular shelving assembly, having two drawers on an anterior side.

Turning to FIG. 8, an alternative embodiment including drawers is shown. The alternative embodiment may include an upper drawer 92 and a lower drawer 94, as shown in FIG. 8. The drawer can be pulled out to allow for objects to be stored therein. The drawer may be installed with any drawer hardware (not illustrated).

Figure 10:
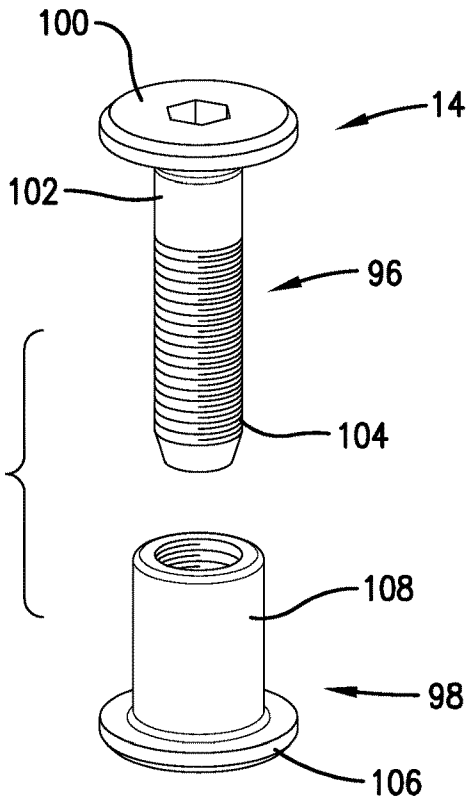
FIG. 10 is a detailed view of the connector.
Figure 9:
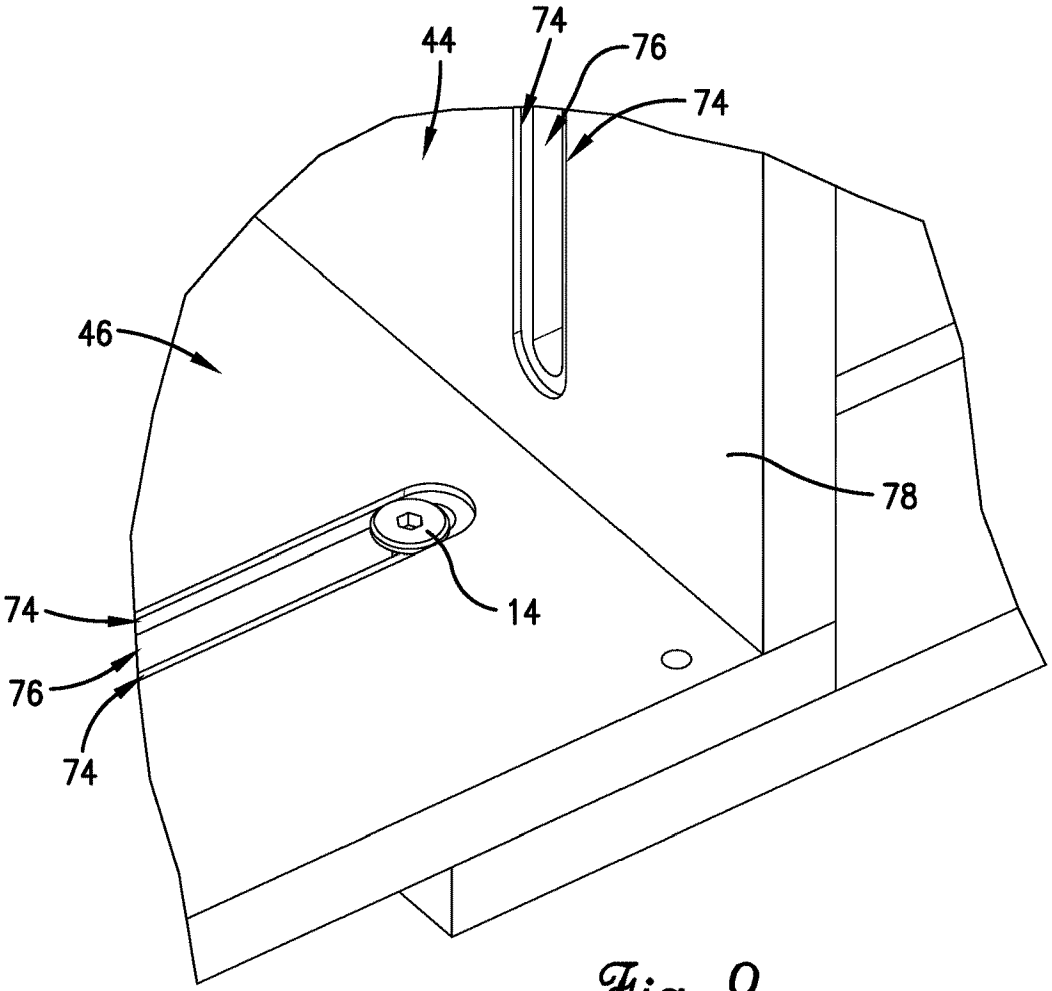
FIG. 9 is a detailed perspective view of an connector installed in a modular shelving system.

Turning to FIGS. 9 and 10, detailed views of the connector 14 are shown. FIG. 9 shows the connector 14 installed and securing the wall 38 to an external modular shelf assembly 12 (not illustrated). The connector 14 is configured to traverse the channel opening 16. As shown, the connector 14 traverses through the traversing channel 76 and rests against the head recess 74. As can be appreciated, the connector 14 could be secured anywhere along the channel opening 16, such that the user can select a precise and customized arrangement of the respective modular shelf assemblies 12. The connector 14 is configured to secure the first wall 38 to an external modular shelf assembly 12 via the channel opening 16 in the first position 70, in the second position 72, or in any of the intermediary positions.

FIG. 10 shows the connector 14 uninstalled and unassembled to show the components thereof. In embodiments, as shown in FIG. 10, the connector 14 may be described as an interlocking fastener. In embodiments of the invention, the connector 16 comprises a bolt body 96 and a cap body 98. The bolt body 96 is configured to be secured to the cap body 98 so that the two respective modular shelf assemblies 12 will correspondingly be secured together. The cap body 98 is configured to receive at least a portion of the bolt body 96 therein.

In embodiments of the invention, the bolt body 96 comprises a head 100, a shank 102, and a out-threaded segment 104. The shank 102 is disposed between the head 100 and the threaded segment 104. In embodiments of the invention, the cap body 98 comprises a head 106 and an in-threaded segment 108. The in-threaded segment 108 is complementary to the out-threaded segment 104. The in-threaded segment 108 and the out-threaded segment 104 each present a helical protrusion that is configured to receive one-another. The head 100 and the head 106 are each configured to interface with the head recess 74 of the channel opening 16. The head 100 and the head 106 are also configured to receive one or more tools therein (such as a hex key or a screwdriver) for purposes of holding and/or turning.

In other embodiments, at least a portion of the connector 14 may be built into the modular shelf assembly 12. For example, the corrector 14 may include a cleat (not illustrated) configured to interlock with another cleat of the other modular shelf assembly 12. As another example, the cleat may be configured to interact with an interlocking fastener that is independent of, but configured to be secured to, the modular shelf assembly 12.

Exemplary Methods of Assembly

Broadly, embodiments of the invention are directed to a method of assembling a modular shelving system 10. The user will select a certain area or physical space upon which to assemble the modular shelving system 10. This physical space may be in a building, a vehicle, a temporary location, or other location. The user may measure the physical space to determine a desired spacing between the modular shelf assemblies 12. By measuring a lateral distance of the available physical space, the user may select the number and spacing of the modular shelf assemblies 12. The user may also select one or more size and shape of modular shelf assembly 12 based upon the available physical space.

The method of assembling a modular shelving system 10 configured to store objects may include any of numerous steps. The user will acquire a set of modular shelf assemblies 12. This can include acquiring a first modular shelf assembly 12, acquiring a second modular shelf assembly 12, acquiring a third modular shelf assembly 12, and so on. This step may also include assembling the modular shelf assemblies 12 from the components thereof. Assembling the modular shelf assemblies 12 may be performed by aligning a first wall and a second wall of the modular shelf assembly 12, applying a fastener between a first wall and a second wall of the modular shelf assembly 12, and continuing to apply fasteners 58 between the set of walls 38 of the modular shelf assembly 12.

In assembling the modular shelving system 10, the user will acquire a set of connectors 14. The user will secure, via the set of connectors 14, the first modular shelf assembly 12 to the second modular shelf assembly 12. The user will also secure, via the set of connectors 14, the first modular shelf assembly 12 to the third modular shelf assembly 12. In doing so, the user will form a variable storage void 36 between the first modular shelf assembly 12, the second modular shelf assembly 12, and the third modular shelf assembly 12. The first modular shelf assembly 12, the second modular shelf assembly 12, the third modular shelf assembly 12, and the variable storage void 36 are each configured to store objects therein.

The step of securing the first modular shelf assembly 12 to the second modular shelf assembly 12 is performed by: inserting a first connector 14 through a first channel opening 66 of the first modular shelf assembly 12 at a first position 70; inserting the first connector 14 through a first channel opening 66 of the second modular shelf assembly 12 at a first position 70; and locking the first connector 14. Locking of the first connector 14 may be performed by inserting the bolt body 96 into the cap body 98 and applying a rotational force to at least one of the bolt body 96 and the cap body 98.

The step of securing the first modular shelf assembly 12 to the second modular shelf assembly 12 is further performed by inserting a second connector 14 through a second channel opening 68 of the first modular shelf assembly 12 and inserting the second connector 14 through a second channel opening 68 of the second modular shelf assembly 12. The second channel openings 16 are parallel to the respective first channel openings 16. The user will then lock the second connector 14. The second connector 14 secures a relative orientation of the first modular shelf assembly 12 and the second modular shelf assembly 12. With only a single connector 14, the first modular shelf assembly 12 may pivot relative to the second modular shelf assembly 12 (or vice versa).

Similarly, the step of securing the first modular shelf assembly 12 to the third modular shelf assembly 12 is performed by inserting a third connector 14 through said first channel opening 66 of said first modular shelf assembly 12 at a second position 72, and inserting the third connector 14 through a first channel opening 66 of the third modular shelf assembly 12.

The materials used and methods of manufacturing various embodiments of the invention will now be discussed. It should be appreciated that any of various materials and methods of manufacture may be in producing any of the various embodiments of the invention. Some embodiments of the invention, the modular shelf assembly 12 may be formed of wood. The various channels and openings (discussed above) may be cut into the wood. The connectors 14 may be formed of metal. In other embodiments, the modular shelf assembly 12 may be formed of another material, such as a metal, a composite, a polymer, or the like. In some embodiments, the modular shelf assembly may be unitary, e.g. cast as a single unit. In these embodiments, the modular shelf assembly may not include the above-discussed distinct walls.

Additional Considerations

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claim(s) set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in the paragraph shall apply unless so stated in this description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

We claim:

1. A modular shelving system configured to store objects therein, comprising:

a first modular shelf assembly presenting a first storage void;

wherein the first modular shelf assembly includes a set of walls including a first wall, a second wall, a third wall, and a fourth wall;

wherein each wall of the set of walls includes a first channel opening and a second channel opening therein, wherein the first channel opening and the second channel opening each have a first position and a second position therein, the first position being laterally distinct from the second position, a second modular shelf assembly presenting a second storage void;

a third modular shelf assembly presenting a third storage void; and a set of connectors, wherein the first modular shelf assembly is configured to be secured, via the set of connectors, to the second modular shelf assembly and to the third modular shelf assembly, wherein the set of connectors is configured to be secured through at least one of the channel openings, wherein a fourth storage void is formed between the first storage void, the second storage void, and the third storage void.

2. The modular shelving system of claim 1, wherein the second modular shelf assembly and the third modular shelf assembly are separated by a lateral distance, wherein the lateral distance is selected by a user to fill a physical space.

3. The modular shelving system of claim 2, wherein the fourth storage void presents a width defined by the lateral distance.

4. The modular shelving system of claim 1, wherein the first channel opening is disposed parallel to the second channel opening;

wherein the set of connectors includes a second connector configured to traverse the second channel opening, wherein the second connector is configured to secure the first wall to the second modular shelf assembly via the second channel opening.

5. The modular shelving system of claim 1, wherein the first modular shelf assembly further includes:

a fastener, wherein the first wall presents a first fastener opening, wherein the second wall presents a second fastener opening, wherein the first fastener opening is configured to be aligned with the second fastener opening such that the fastener can permanently secure the first wall to the second wall via the first fastener opening and the second fastener opening.

6. A modular shelf assembly comprising:

a set of walls presenting a storage void therein, wherein the set of walls includes a first wall, a second wall, a third wall, and a fourth wall;

a first channel opening and a second channel opening disposed in each wall of the set of walls, wherein each of the first channel openings and the second channel openings present a first position and a second position therein, wherein the first position is laterally distinct from the second position; and a connector configured to traverse at least one of the channel openings, wherein the connector is configured to secure the first wall to an external modular shelf assembly via the channel opening in the first position, wherein the connector is configured to secure the first wall to the external modular shelf assembly via the channel opening in the second position.

7. The modular shelf assembly of claim 6, wherein the connector is a first connector, wherein the first channel opening is disposed parallel to the second channel opening, further comprising:

a second connector configured to traverse the second channel opening, wherein the second connector is configured to secure the first wall to said external modular shelf assembly via the second channel opening.

8. The modular shelf assembly of claim 6, wherein the set of walls further includes a posterior wall, wherein the posterior wall is adjacent to the first wall, the second wall, the third wall, and the fourth wall.

9. The modular shelf assembly of claim 6, wherein the set of walls further includes a door, wherein the door is pivotably secured to the first wall and the second wall, such that the door may pivotably swing open.

10. The modular shelf assembly of claim 6, further comprising:

a fastener, wherein the first wall presents a first fastener opening, wherein the second wall presents a second fastener opening, wherein the first fastener opening is configured to be aligned with the second fastener opening such that the fastener can permanently secure the first wall to the second wall via the first fastener opening and the second fastener opening.

* * * * *